United States Patent [19]

Weir

[11] 4,234,179

[45] Nov. 18, 1980

[54] LAUNDRY FOLDING MACHINE

[76] Inventor: Henry J. Weir, "Alta Vista", 2, Knapton Rd., Monkstown, Dublin, Ireland

[21] Appl. No.: 30,874

[22] Filed: Apr. 17, 1979

Related U.S. Application Data

[63] Continuation of Ser. No. 779,228, Mar. 18, 1977, abandoned.

[51] Int. Cl.[3] ..... B65H 45/14

[52] U.S. Cl. ..... 493/14; 493/28; 493/37; 493/418; 493/937

[58] Field of Search ..... 270/68 R, 68 A, 69

[56] References Cited

U.S. PATENT DOCUMENTS

| | | | |
|---|---|---|---|
| 2,011,934 | 8/1935 | Kahn | 270/68 R |
| 3,559,983 | 2/1971 | Sjostrom | 270/69 |
| 3,747,917 | 7/1973 | Roda | 270/68 R |
| 3,953,613 | 4/1976 | Morgenthaler | 270/68 R |

FOREIGN PATENT DOCUMENTS

| | | | |
|---|---|---|---|
| 1363327 | 8/1974 | United Kingdom | 270/68 R |

*Primary Examiner*—E. H. Eickholt

*Attorney, Agent, or Firm*—Wenderoth, Lind & Ponack

[57] ABSTRACT

A laundry folding machine for imparting initial folds to an article is disclosed. The article is fed from a first conveyor to a second conveyor across a fold gap which is bridged at this time. The second conveyor pauses and then reverses, a suspended loop being thus formed in the article beneath the fold gap. Finally, the hanging article is tucked into a fold mechanism at the quarter and three-quarter position, thereby folding the article into quarters.

12 Claims, 6 Drawing Figures

PULSE UNIT
20
FIRST SENSOR
18
SECOND SENSOR
19
MC1
GATE
25
22
COUNTER
33a
GATE
FORWARD
STOP
2 nd CONVEYOR
X2
GATE
GATE
REVERSE
32
31
33b
MC2
GATE
26
23
COUNTER
OPERATE
FOLD MECHANISM
X4
GATE
35
34
MC3
27
24
GATE
COUNTER
START
STOP
BRIDGING MECHANISM
DELAY
28
RESET

LAUNDRY FOLDING MACHINE

This is a continuation of application Ser. No. 779,228 filed Mar. 18, 1977, and now abandoned.

BACKGROUND AND SUMMARY OF THE INVENTION

This invention relates to a folding machine for folding sheets. Such a machine is particularly suitable for use in a laundry, where it may be located to fold flatwork articles such as sheets, tablecloths, pillow cases and the like which issue from an ironing machine. For ease of explanation the term "sheet" will be used herein throughout to refer to such an article. However, the scope of the invention is not intended to be restricted to sheets per se.

It is customary when processing a sheet in a laundry to iron it in, for example, a calendar ironer, whence it passes to a folding machine.

In practice, two folding machines are generally used, namely a primary folder which makes two transverse folds across the length of the sheet and a cross-folder which makes two or three folds at right angles to the primary folds.

The present invention is concerned with a primary folder of a type wherein sheets are folded at a desired fold line by tucking the fold line between contra-rotating rollers or conveyors.

Usually folders of this type measure the sheet to find its length and then they fold the sheet in half and in half again. To do this they generally require a sensor located on an input conveyor of the folder at least as far in front of the fold mechanism as half the length of the longest sheet to be folded. Thus folders of this type tend to be long.

Such a long machine can be inconvenient to the amount of space it occupies. In addition the length of such a machine, which is adapted to fold long sheets, may necessitate the incorporation of a memory in the machine. This memory is required to enable the machine to differentiate between short sheets which follow each other closely through the machine.

The present invention seeks to provide an improved primary folding machine. According to one aspect of the invention there is provided a folding machine for folding sheets comprising a first sheet conveyor; a second sheet conveyor; drive means for the second conveyor capable of driving the second conveyor forwardly in the same direction as the first conveyor, stopping the second conveyor movement to give a pause, and driving the second conveyor in reverse; a fold gap between the the conveyors; a bridging mechanism for controllably bridging the fold gap; a fold mechanism beneath the fold gap; and a measuring device for measuring sheets fed on to the first conveyor. The measuring device is effective to determine and control the times at which the bridging mechanism is operated, the second conveyor pauses and reverses, and the fold mechanism operates.

According to another aspect of the invention there is provided a method of folding a sheet, firstly in half at its midpoint and secondly in half again at its quarter and three-quarter points. The method includes the steps of feeding the sheet from a first conveyor across a fold gap on to a second conveyor; arresting the movement of the second conveyor for a determined pause time, a loop being formed in the sheet beneath the fold gap at the pause and at the reverse of the second conveyor; and tucking the doubled sheet of the loop into a fold mechanism at the quarter and three-quarter points of the sheet.

The provision of a pause in the movement of the second conveyor before reversal allows a long sheet to be fed into a loop beneath the fold gap. The arrangement allows the over-all length of the machine and the measuring station to be relatively short, even for long sheets. The length of the pause necessary will depend upon the length of the sheet. For sheets below a certain length there will be no pause and reversal of the second conveyor will be immediate.

BRIEF DESCRIPTION OF THE DRAWINGS

In order that the invention may be more readily understood, various embodiments thereof will now be described with reference to the accompanying drawings, of which.

DETAILED DESCRIPTION OF THE INVENTION

Figure 1:
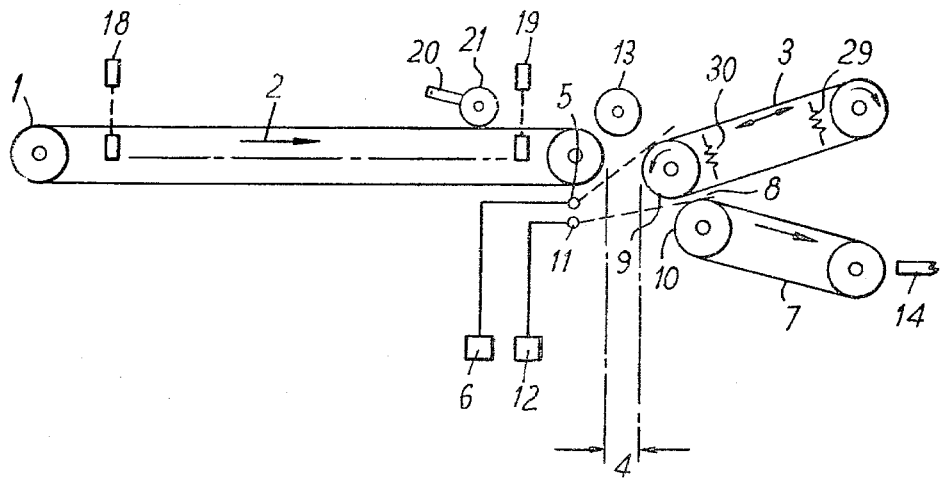
FIG. 1 is a diagrammatic side view of a folding machine according to the invention.

Referring to FIG. 1, a first conveyor 1 is adapted to receive sheets from its left-hand end (as seen in FIG. 1) and convey them in the direction shown by arrow 2 to a second conveyor 3. A fold gap 4 is defined by the adjacent ends of the two conveyors. A tube 5 extending laterally of the conveyors and having holes directed towards the fold gap constitutes a bridging mechanism. In operation pressurised air is applied to the tube 5 from a source 6 and this results in a series of jets of air being directed across the fold gap 4 from the holes. The jets prevent the leading edge of a sheet from falling through the fold gap while they are in operation.

A third conveyor 7 running about one end roller 10 is disposed below the second conveyor 3 which runs about one end roller 9. As will be explained below, a sheet is folded by tucking the hanging sheet into the nip 8 between the conveyors at rollers 9 and 10. Tucking of the sheet into the nip 8 is effected by air jets from a series of holes in a tube 11, the tube being supplied with pressurised air from a source 12 at the appropriate time. Thus the tube 11, source 12 and the rollers 9 and 10 constitute a fold mechanism.

A guide roller 13 is provided for steadying the leading edge of a sheet as it passes over the fold gap. A table 14 for receiving a folded sheet is provided at the output end of the third conveyor.

Figure 2:
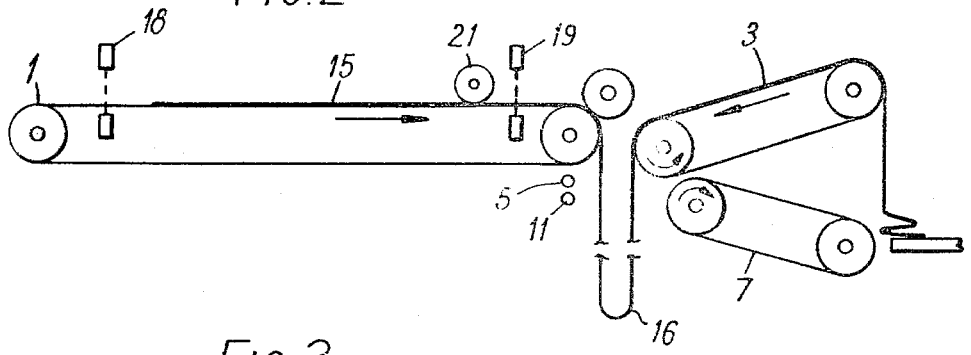
FIG. 2 is also a diagrammatic side view of the machine of FIG. 1 showing a sheet being folded.

In operation, (see FIGS. 2 and 3) a sheet 15 is fed on to the first conveyor 1. Generally, the sheet is fed from an ironer which runs at a fixed speed. The folding machine is set to run at a higher speed, but its drive is allowed to slip while the sheet is still issuing from the ironer. This keeps the sheet taut and crease-free. When the leading edge of the sheet is crossing the fold gap 4, the bridging mechanism is operated until the leading edge is supported by the second conveyor 3 which runs at the same speed as the first conveyor. The leading edge of the sheet is shown collecting on the table 14 since the second conveyor is intentionally not long enough to accommodate the full length of sheet fed on to it. At an appropriate time the second conveyor is stopped so that the sheet is fed in a loop through the fold gap. Next, the second conveyor is started in the reverse direction. This timing is determined in a manner to be described and coincides with the time the midpoint of the sheet reaches the middle of the loop.

Figure 3:
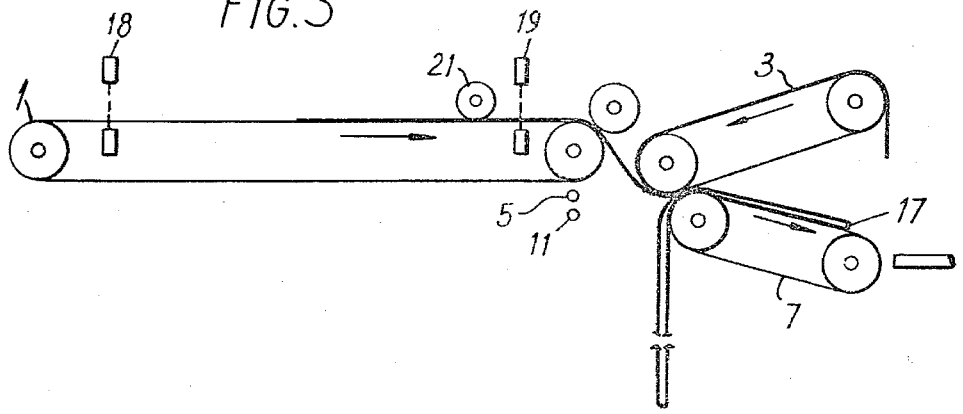
FIG. 3 is the same view as FIG. 2, showing the sheet nearly completely folded.

By the time the stage shown in FIG. 3 is reached, the fold mechanism has been operated to tuck the quarter and three-quarter points 17 of the sheet into the nip between the conveyors 3 and 7 which at this time are contra-rotating to feed the folded sheet towards the table 14 as shown.

Figure 4:
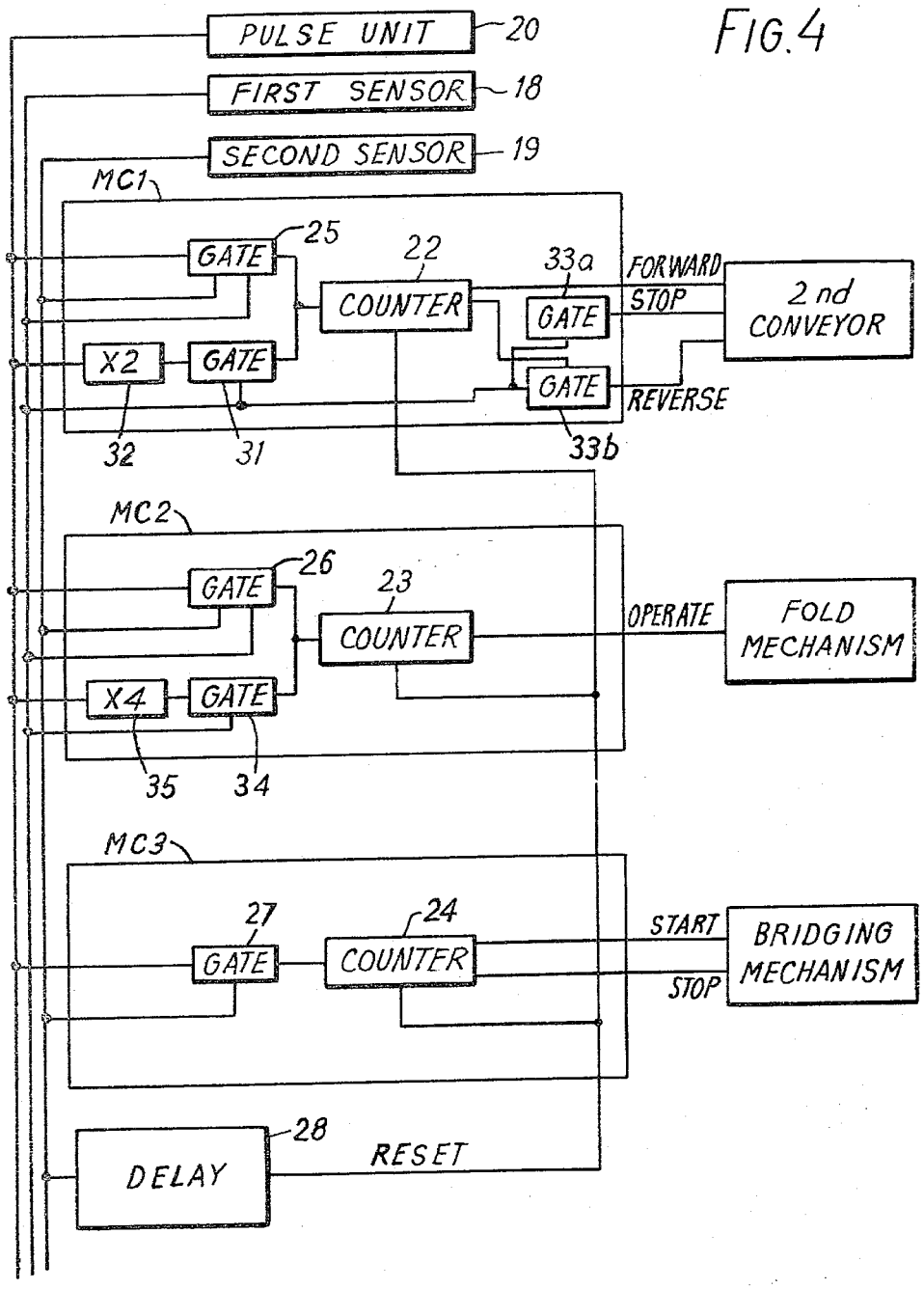
FIG. 4 is a block diagram of a measuring device for the machine of FIG. 1.

A measuring device is required for controlling the operation of the folding machine. The measuring device, which is shown diagrammatically in FIG. 4, receives its inputs from first and second sensors 18, 19 which are of the photo-electric type, and a pulse unit 20, which is driven by a wheel 21 bearing on the top surface of the sheet and driven thereby to produce a pulse for each unit length of sheet movement. The sensors and pulse unit are shown in FIG. 1.

The measuring device incorporates three measuring circuits MC1, MC2, MC3 which respectively control the second conveyor, the fold mechanism and the bridging mechanism. The measuring circuits contain counters 22, 23, 24 respectively. The counters are of a kind which are pre-set with a predetermined number. When input pulses are applied to a counter, the counter counts down from its pre-set number. When the counter reaches zero an output pulse is given. The counters count pulses derived from the pulse unit 20 and counting is initiated in all the counters when the leading edge of the sheet passes the second sensor 19, which sends a signal to respective gates 25, 26 and 27. It is convenient to use the second sensor, i.e., the downstream sensor, to initiate the counters, since by then an appreciable length of the sheet is on the first conveyor. This minimises the possibility of slip between the first conveyor and the sheet once the counters have been initiated. The counters are all reset by a signal from a delay unit 28, which signal is generated at a delayed time after the trailing edge of the sheet has passed the second sensor.

The first measuring circuit MC1 controls the second conveyor by actuating clutches 29, 30 which are shown diagrammatically on FIG. 1; the engagement of clutch 29 driving the conveyor forwards and the engagement of the clutch 30 driving the conveyor in reverse. The counter 22 is set to elapse when a critical length of sheet has passed the first sensor. The critical length in the embodiment is 52", namely twice the distance from the first sensor to the fold gap center, in this embodiment 26". Since the counter is initiated by the leading edge passing the second sensor which is, in this embodiment, 21" from the first sensor, the counter must elapse after 52"−21"=31" of sheet movement have been counted. The distance from the second sensor 19 to the center of the fold gap 4 is 5". Thus, the counter elapses when 26" of sheet have passed beyond the fold gap center. If the pulse unit 20 produces a pulse for every 0.2" of movement, the counter 22 elapses after $31\times(1/0.2)=155$ pulses. The counter therefore gives a signal for the second conveyor to reverse after counting 155 pulses.

If a sheet that is shorter than 52" is to be folded, the trailing edge will pass the first sensor before the counter 22 has elapsed, whereupon the first sensor sends a signal to a gate 31 which passes the pulse unit pulses to a frequency doubler 32 so that the counter counts twice as fast. The gate 25 ceases to pass pulses since the same signal closes it. Thus the counter 22 elapses when the midpoint of the sheet is at the middle of the fold gap.

If a sheet which is longer than the critical length is to be folded, the counter 22 will elapse when half the critical length of sheet is on the second conveyor. The second conveyor is thus stopped. In order to stop the conveyor quickly not only is the forward clutch 29 disconnected but the reverse clutch 30 is connected briefly to act as a brake.

The measuring circuit includes two gates **33*a* and 33*b*. Gate 33*a* is normally open and thereby passes a received signal from counter 22 when the counter elapses. The signal is passed to a STOP output which stops the second conveyor. The gate is closed by the signal from sensor 18**.

Gate **33*b* is normally closed and is opened by the output from counter 22 when the counter elapses. This gate, when open, passes the signal from sensor 18** to a REVERSE output which reverses the second conveyor.

Thus, for a short sheet the signal from sensor 18 is received before counter 22 elapses and reversal of the conveyor is effected immediately. For a long sheet the counter 22 elapses before the sensor 18 issues a signal and the STOP signal is thus issued when the counter elapses, to be followed by the REVERSE signal when the sensor 18 responds.

The measuring circuit MC2 controls the fold mechanism, i.e., activates the jets of air which divert the quarter and three-quarter points of the sheet into the nip between the conveyors 3 and 7. The jets are set at one quarter of the maximum sheet length from the first sensor, in this case 120/4=30". Since the position of the jets is 4" below the fold gap centre, the length of the first conveyor is about one quarter of the length of the longest sheet to be folded. The counter 23 is set to elapse when the trailing edge of a maximum-length sheet passes the first sensor. Since the counter 23 is initiated by the leading edge passing the second sensor the counter must count 120"−21"=99", that is, $99''\times(1/0.2)=495$ pulses. When a sheet of less than maximum length is to be folded, the first sensor sends a signal when the trailing edge passes the sensor. The signal is passed to a gate 34 between a signal quadrupler 35 and the counter. The quadrupler quadruples the output from the pulse unit. The signal from the first sensor also closes gate 26. Thus, the counter will elapse when the quarter and three-quarter points are opposite the fold mechanism.

The third counting circuit MC3 is set to elapse after counting 45 pulses so that the bridging mechanism jets of air cease when the trailing edge is 9" past the second sensor.

The delay is typically set to reset the counters half a second after the trailing edge of the sheet passes the second sensor. The delay is of course only responsive to the trailing, as opposed to the leading, edge of the sheet.

Operation of the measuring circuits MC1, MC2 of the measuring device is based on the following general principles. The first counter elapses when the middle of the sheet is at the middle of the fold gap for a sheet which is shorter than the critical length, and at the bottom of the loop for a longer sheet. The second counter elapses when the quarter and three-quarter points are opposite the fold mechanism. For operation of the latter function it is convenient to arrange for the second counter to elapse as the trailing edge of the longest expected sheet passes the first sensor. Thus, the distance from the first sensor to the fold mechanism is one quarter the length of the longest sheet which the machine is intended to fold. Since the second counter is initiated by the leading edge passing the second sensor, when the leading edge has travelled from the first to the second sensor, the second counter is preset to elapse after it has counted sheet movement equivalent to the length of the longest sheet less the separation of the sensors. For sheets of less than maximum length the second counter must elapse after the trailing edge has moved past the first sensor by a distance equal to a quarter of the difference between the longest and actual sheet length since the twice-folded sheet is a quarter the length of the unfolded sheet. Thus the first sensor quadruples the count rate of the second sensor when the trailing edge passes.

For a sheet of critical length, the first counter is set to elapse when the trailing edge passes the first sensor. At this time the midpoint of the sheet will be at the middle of the fold gap, the critical length being equal to twice the distance from the first sensor to the fold gap center. Thus, in this case the second conveyor is reversed immediately without a pause. For a sheet of less than the critical length the first counter's rate of counting is doubled by the passage of the trailing edge past the first sensor, for reasons similar to the quadrupling in respect of the second counter. Again, this means that when the first counter elapses the midpoint of the sheet is at the center of the fold gap. Reversal of the second conveyor takes place immediately without a pause. For a sheet of more than critical length, when the first counter elapses half the critical length of sheet will be beyond the fold gap center. The second conveyor will then pause. The second conveyor is reversed when the same length is still on the first conveyor, i.e., when the trailing edge passes the first sensor.

Figure 5:
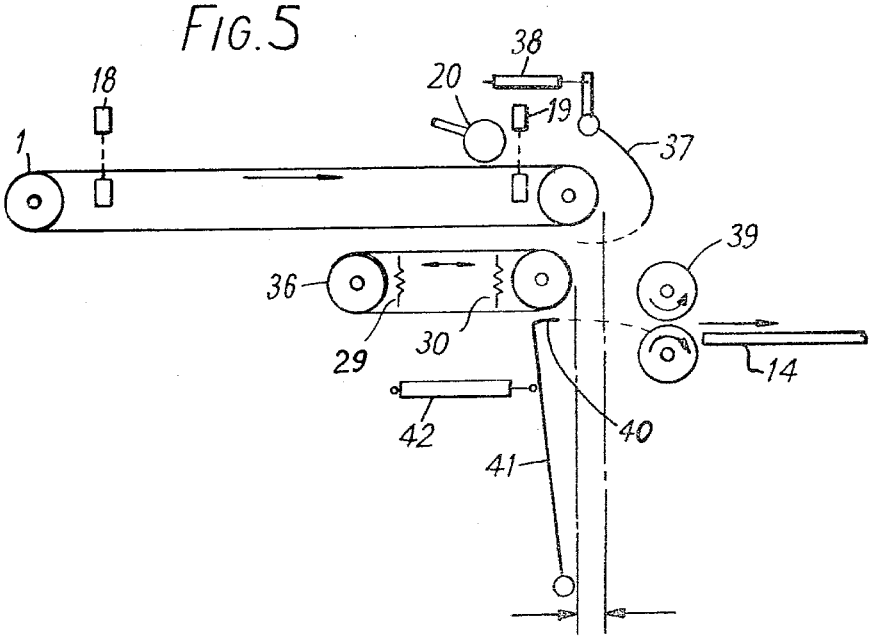
FIG. 5 is a diagrammatic side view of another folding machine according to the invention.
Figure 6:
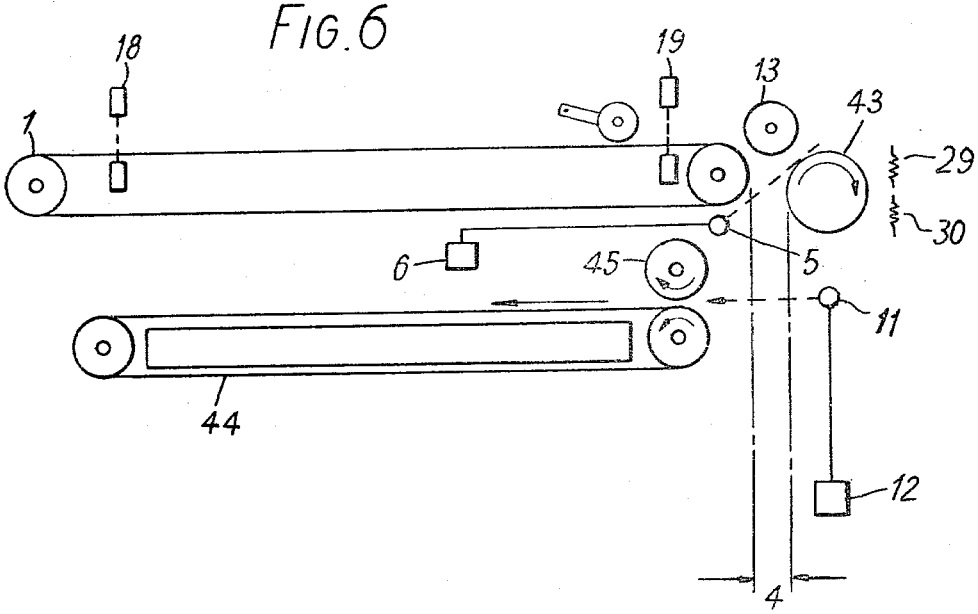
FIG. 6 is also a diagrammatic side view of a third folding machine according to the invention.

FIG. 5 shows another embodiment of a folding machine according to the invention wherein the second conveyor 36 is disposed underneath the first conveyor 1. The bridging mechanism incorporates a row of metal fingers 37 operated by a hydraulic or pneumatic actuator 38. The folder is a pair of rollers 39, and the fold mechanism incorporates a metal blade 40 pivoted on an arm 41 and operated by a pneumatic or hydraulic actuator 42. Although this folding machine of FIG. 5 is structurally substantially different from that described above with reference to FIGS. 1 to 4, it can be used in an exactly analogous manner; as indeed can the folding machine shown in FIG. 6. This latter machine has a single roller 43 which constitutes the second conveyor. In other respects it is similar to the first-described folding machine according to the invention except that a third conveyor 44 and associated folder roller 45 are disposed underneath the first conveyor. The third conveyor may constitute part of a cross-folder.

The invention is not intended to be restricted to the embodiments described hereinabove. So far as the smaller details are concerned, the sensors need not be of the photo-electric type, they may be capacitive or mechanical microswitch sensors. The pulse unit may operate directly from the conveyor as opposed to the sheet. The table for receiving the folded sheets may be replaced by a conveyor, generally leading to a cross-folder.

The measuring device may be of a kind other than that described, and may incorporate compensation for the delays in the stopping and reversal of the second conveyor. More fundamentally, the measuring device may control the second conveyor and the folding mechanism in a different manner than that described above in respect of the general principles of the measuring circuits MC1, MC2. In particular, the second conveyor may be run at speeds other than that of the first conveyor, and the second conveyor may be reversed at a time other than when the midpoint of the sheet is at the bottom of the loop.

Finally, the invention is not intended to be restricted to laundry folding machines. A machine according to the invention might be used for folding sheets or like articles in the factory where they are produced. It might even be used for folding sheet plastics or paper articles.

I claim:

1. A folding machine for folding a flat article having leading and trailing edges, said machine comprising:

first conveyor means for carrying an article to be folded in a forward direction;

second conveyor means, adjacent and spaced from said first conveyor means by a space, for receiving the leading edge of said article carried on said first conveyor means and carrying said article in the same direction as said first conveyor means, for halting the movement of said leading edge for a predetermined period of time, and for reversing the direction of travel of said leading edge following said halt in movement thereof into said space between said first and second conveyor means;

said space between said first and second conveyor means being a folding gap;

first bridging means at said folding gap for controlling the movement of said article through said folding gap toward said second conveyor means, said first bridging means comprising:

a high pressure air source, and a hollow lateral tube connected to said high pressure air source and positioned at said folding gap opposite said second conveyor means, said tube having a plurality of openings therein directed toward said second conveyor means across said folding gap;

folding mechanism means spaced from said second conveyor means and adjacent said folding gap for receiving and folding a portion of said article in said folding gap;

second bridging means at said folding gap opposite said folding mechanism means for directing a portion of said article in said folding gap toward said folding mechanism means; and measuring means along said first conveyor means for measuring the distance of travel of said article therealong, and connected to said second conveyor means for controlling the forward movement, halting and rearward movement thereof in relation to the length of travel of said article on said first conveyor means, and connected to said bridging means and said folding mechanism means for controlling the operation thereof in accordance with the length of travel of the article on said first conveyor means.

2. A folding machine for folding a flat article having leading and trailing edges, said machine comprising:

first conveyor means for carrying an article to be folded in a forward direction;

second conveyor means, adjacent and spaced from said first conveyor means by a space, for receiving the leading edge of said article carried on said first conveyor means and carrying said article in the same direction as said first conveyor means, for halting the movement of said leading edge for a predetermined period of time, and for reversing the direction of travel of said leading edge following said halt in movement thereof into said space between said first and second conveyor means;

said space between said first and second conveyor means being a folding gap;

first bridging means at said folding gap for controlling the movement of said article through said folding gap toward said second conveyor means, said first bridging means comprising:

a movable fluid-operated actuator adjacent said first conveyor means, and at least one finger connected to said fluid-operated actuator and movable therewith toward and away from said folding gap;

folding mechanism means spaced from said second conveyor means and adjacent said folding gap for receiving and folding a portion of said article in said folding gap;

second bridging means at said folding gap opposite said folding mechanism means for directing a portion of said article in said folding gap toward said folding mechanism means; and measuring means along said first conveyor means for measuring the distance of travel of said article therealong, and connected to said second conveyor means for controlling the forward movement, halting and rearward movement thereof in relation to the length of travel of said article on said first conveyor means, and connected to said bridging means and said folding mechanism means for controlling the operation thereof in accordance with the length of travel of the article on said first conveyor means.

3. A folding machine for folding a flat article having leading and trailing edges, said machine comprising:

first conveyor means for carrying an article to be folded in a forward direction;

second conveyor means, adjacent and spaced from said first conveyor means by a space, for receiving the leading edge of said article carried on said first conveyor means and carrying said article in the same direction as said first conveyor means, for halting the movement of said leading edge for a predetermined period of time, and for reversing the direction of travel of said leading edge following said halt in movement thereof into said space between said first and second conveyor means;

said space between said first and second conveyor means being a folding gap;

first bridging means at said folding gap for controlling the movement of said article through said folding gap toward said second conveyor means;

folding mechanism means spaced from said second conveyor means and adjacent said folding gap for receiving and folding a portion of said article in said folding gap;

second bridging means at said folding gap opposite said folding mechanism means for directing a portion of said article in said folding gap toward said folding mechanism means, said second bridging means comprising:

a high pressure air source, and a hollow lateral tube connected to said high pressure air source and positioned at the side of said folding gap opposite the space between said second conveyor means and said folding mechanism means, said tube having a plurality of openings therein directed toward said space between said second conveyor means and said folding mechanism means across said folding gap; and measuring means along said first conveyor means for measuring the distance of travel of said article therealong, and connected to said second conveyor means for controlling the forward movement, halting and rearward movement thereof in relation to the length of travel of said article on said first conveyor means, and connected to said bridging means and said folding mechanism means for controlling the operation thereof in accordance with the length of travel of the article on said first conveyor means.

4. A folding machine for folding a flat article having leading and trailing edges, said machine comprising:

first conveyor means for carrying an article to be folded in a forward direction;

second conveyor means, adjacent and spaced from said first conveyor means by a space, for receiving the leading edge of said article carried on said first conveyor means and carrying said article in the same direction as said first conveyor means, for halting the movement of said leading edge for a predetermined period of time, and for reversing the direction of travel of said leading edge following said halt in movement thereof into said space between said first and second conveyor means;

said space between said first and second conveyor means being a folding gap;

first bridging means at said folding gap for controlling the movement of said article through said folding gap toward said second conveyor means;

folding mechanism means spaced from said second conveyor means and adjacent said folding gap for receiving and folding a portion of said article in said folding gap;

second bridging means at said folding gap opposite said folding mechanism means for directing a portion of said article in said folding gap toward said folding mechanism means, said second bridging means comprising:

a movable fluid-operated actuator adjacent said first conveyor means, and at least one finger attached to said fluid-operated actuator and movable back and forth through said folding gap toward and away from said folding mechanism means; and measuring means along said first conveyor means for measuring the distance of travel of said article therealong, and connected to said second conveyor means for controlling the forward movement, halting and rearward movement thereof in relation to the length of travel of said article on said first conveyor means, and connected to said bridging means and said folding mechanism means for controlling the operation thereof in accordance with the length of travel of the article on said first conveyor means.

5. A method of folding a flat article having a leading edge and a trailing edge, said method comprising the steps of:

moving said article on a moving first conveyor across a folding gap toward a second conveyor moving the same direction as said first conveyor and carrying said article on said second conveyor while bridging said gap;

stopping said second conveyor while said article is being carried thereby, before the midpoint of the length of said article has reached said gap, and continuing the movement of said first conveyor, whereby a loop of said article is formed in said gap between said two conveyors;

after a predetermined period of pause sufficient to enable said midpoint of the length of said article to enter said gap and reach a predetermined position, reversing the direction of movement of said second conveyor, whereby said first and second conveyors move in opposite directions; and during the reverse movement of said second conveyor, tucking said article in said gap into a folding mechanism.

6. A method as claimed in claim 5, further comprising operating said first and second conveyors at the same speed when said first and second conveyors move in the same direction and when said first and second conveyors move in opposite directions.

7. A method as claimed in claim 6, wherein the pausing and reverse rotation of said second conveyor are controlled by a counter means adjacent said first conveyor for counting unit lengths of said article between said leading and trailing edges at a uniform rate.

8. A method as claimed in claim 7, wherein a sensor adjacent said first conveyor and connected to said counter means sense the trailing edge of said article on said first conveyor and adjusts the counting rate of said counting means.

9. A method as claimed in claim 5, wherein said predetermined position of said midpoint of the length of said article comprises the bottom of said loop between said two conveyors.

10. A method as claimed in claim 5, wherein said loop is free-falling and is maintained unrestrained.

11. A method as claimed in claim 5, wherein said step of tucking comprises directing jet of gas against a portion of said article, and thereby moving said portion into said folding mechanism.

12. A method as claimed in claim 5, wherein said step of tucking comprises moving at least one finger member against a portion of said article, and thereby moving said portion into said folding mechanism.

* * * * *